United States Patent [19]

Buysman et al.

[11] 4,069,085

[45] Jan. 17, 1978

[54] APPARATUS FOR FORMING APERTURES IN A THIN METAL TAPE SUCH AS A SHADOW MASK FOR A COLOR TELEVISION DISPLAY TUBE

[75] Inventors: Petrus Johannes Buysman; Gerardus Antonius Wilhelmus Vermeulen; Cornelis Arie Bos, all of Eindhoven, Netherlands

[73] Assignee: U.S. Philips Corporation, New York, N.Y.

[21] Appl. No.: 617,524

[22] Filed: Sept. 29, 1975

Related U.S. Application Data

[63] Continuation of Ser. No. 485,845, July 5, 1974, abandoned.

[30] Foreign Application Priority Data

July 16, 1973 Netherlands ..... 7309840

[51] Int. Cl.[2] ..... C23F 1/02

[52] U.S. Cl. ..... 156/345; 156/290; 156/631; 156/640; 156/661; 156/664

[58] Field of Search ..... 156/16, 345, 247, 11, 156/290, 630, 637, 640, 659, 664, 631, 354, 661; 427/251, 282, 286, 287; 118/49.1, 301, 406; 134/48, 124, 128

[56] References Cited

U.S. PATENT DOCUMENTS

| | | | |
|---|---|---|---|
| 1,971,697 | 8/1934 | Schieren | 156/324 |
| 2,052,962 | 9/1936 | Booe | 156/16 |
| 3,197,324 | 7/1965 | Brooks | 118/301 |
| 3,359,192 | 12/1967 | Heinrich et al. | 156/11 |
| 3,635,730 | 1/1972 | Sweltzer | 427/282 |
| 3,799,792 | 3/1974 | Ryng | 427/286 |
| 3,808,071 | 4/1974 | Lerner | 156/345 |
| 3,809,011 | 5/1974 | Fabre et al. | 427/287 |
| 3,866,565 | 2/1975 | Ridout | 118/49.1 |
| 3,885,520 | 5/1975 | Krumme | 118/49.1 |
| 3,888,745 | 6/1975 | Hoyjo | 156/247 |

*Primary Examiner*—William A. Powell
*Assistant Examiner*—Jerome W. Massie
*Attorney, Agent, or Firm*—Frank R. Trifari; Norman N. Spain

[57] ABSTRACT

A method of forming apertures in a thin metal tape. Cavities having a depth of at least half of the tape thickness are first etched from one side. Etching is then carried out mainly from the other side until apertures having the desired profile have been formed. During etching the first-mentioned side, the said other side is covered with a foil of synthetic resin. Shadow mask for a color television display tube manufactured according to a similar method.

3 Claims, 7 Drawing Figures

APPARATUS FOR FORMING APERTURES IN A THIN METAL TAPE SUCH AS A SHADOW MASK FOR A COLOR TELEVISION DISPLAY TUBE

This is a continuation, of application Ser. No. 485,845, filed July 5, 1974, now abandoned.

The invention relates to a method of forming apertures in a thin metal tape in which the tape is coated on both sides with an etchant-resistant protective layer in which apertures are provided according to a desired pattern, a first of the two sides of the tape is then coated with a closed coating layer which is also etchant-resistant, after which an etchant is sprayed against the tape to form cavities on the second side of the tape which is not covered with the said coating layer, and the coating layer is then removed after which an etchant is sprayed against the tape to form cavities on the first side of the tape in such manner that the cavities on both sides form continuous apertures in the tape.

The invention also relates to a shadow mask for a colour television display tube manufactured according to this method.

Such a method is known from the U.S. Pat. No. 2,750,524. In order to ensure that the apertures obtain the desired profile, in the known method first one of the two sides of the plate is subjected to an initial etching treatment in which a coating layer is provided on the other side, succeeded by etching two of the apertures from said other side. In the known method it is difficult to find a suitable composition for the coating layer which is provided on the first side of the tape, as well as for the solvent for said coating layer. As a matter of fact, neither said coating layer nor the solvent therefor may attack the protective layer in which the pattern of the apertures has been provided. The last-mentioned layer may consist of photosensitive fish-glue which prior to exposure is soluble in water and after exposure can be removed with sodium hydroxide solution. The coating layer may then consist of a wax having a high softening point which can be removed with perchloroethylene. The wax nor the perchloroethylene attacks the layer of fish glue but the perchloroethylene vapours are very detrimental to human beings and the environment. So the installation must be readily sealed and the vapours be sucked off and deposited in carbon filters. This renders the installation very complicated, also as a result of all the safety measures which have to be taken.

The invention provides a method in which said drawbacks are avoided. According to the invention, the coating layer consists of a foil of a synthetic material and that in particular of a foil of synthetic material which forms an endless tape which travels along with the metal tape and which is temporarily adhered to the metal tape at its edges.

Figure 1A:
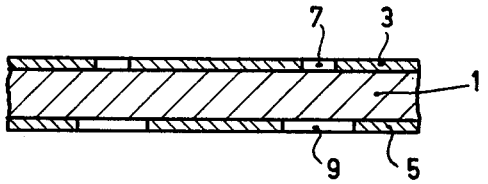
Figure 1B:
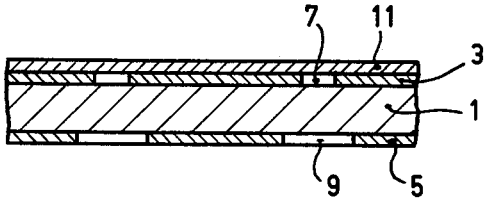
Figure 1C:
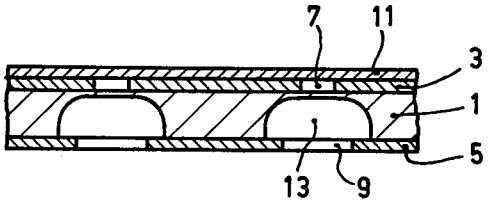
Figure 1D:
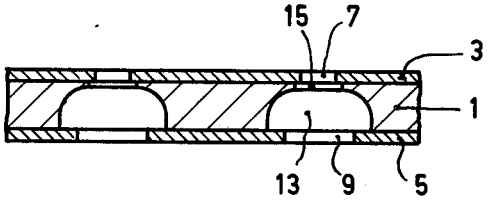
Figure 1E:
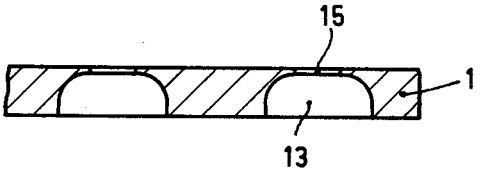
Figure 2:
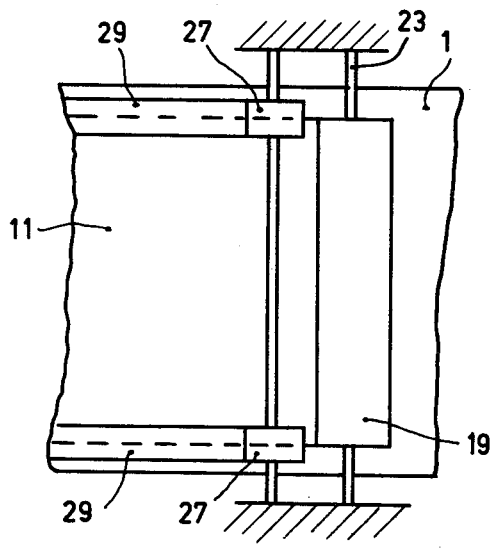
Figure 3:
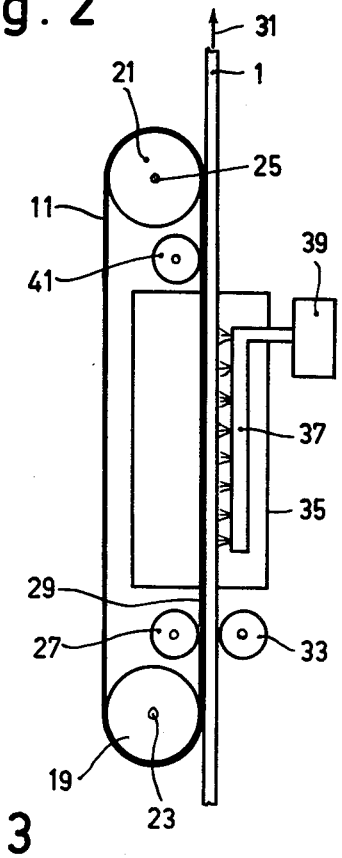

The invention will be described in greater detail with reference to the accompanying drawing, in which:

FIGS. 1A to E inclusive show an illustration of a number of successive steps of an embodiment of the method according to the invention, FIG. 2 is a diagrammatic side elevation of a part of a device for performing the method shown in FIG. 1, FIG. 3 is a diagrammatic plan view of the device shown in FIG. 2.

FIG. 1A is a cross-sectional view of a part of a thin metal tape 1 in which apertures are to be etched, for example, for the manufacture of a colour selection electrode (shadow mask) for a colour television display tube. As is known (for example, from the abovementioned U.S. Pat. No. 2,750,524); said apertures on one side of the shadow mask are preferably larger than on the other side. A protective layer 3 is then provided on the tape 1 on the first side and a protective layer 5 is provided on the second side. Said layers consist of a photosensitive lacquer (for example fish-glue) in which apertures 7 and 9, respectively, are formed according to a given pattern by exposure to light and development. Said process is known per se and will not be described in detail. The apertures 7 on the first side of the tape 1 are smaller than the corresponding apertures 9 on the second so as to give the apertures to be etched in the tape 1 the desired profile. As explained in the already mentioned United States Patent Specification, it is recommendable for the sake of the accuracy of the final product to first seal temporarily the apertures 7 on the first side of the tape 1. The smallest transverse dimension of the apertures ultimately formed in the tape 1 is then determined mainly by the transverse dimensions of the apertures 7. Dependent upon the type of colour display tube for which the shadow mask is destined, the apertures may be, for example, circular or rectangular. The difference in etching depths between the two sides of the tape 1 is achieved by first etching via the apertures 9 and then mainly via the apertures 7. According to the invention, the most favourable way of temporarily sealing the apertures 7 is a coating layer 11 of a foil of a synthetic material (for example, polyethylene) (see figure 1B). As will be explained hereinafter, said layer can be connected in a liquid-tight manner to the protective layer 3 in various manners.

After providing the foil 11, recesses 13 the depth of which is, for example, three fourth of the tape thickness, are etched in the tape 1 on the second side of the tape 1 via the apertures 9 (see FIG. 1C). It is obvious from FIG. 1C that as a result of the lateral etching said cavities 13 have a larger transverse dimension than the apertures 9. When the apertures 13 have reached the desired depth, the etching process is discontinued and the foil 11 is removed. Etching is then continued mainly via the apertures 7 on the first side of the tape 1 so that at the area of said apertures cavities are formed which, after a short period of time, join the first formed recesses 13 so that continuous apertures are formed in the tape 1 (see FIG. 1D). Since in this case the cavities 15 need have only a small depth, the lateral etching at the area of said cavities may also be small so that their transverse dimensions are substantially equal to the corresponding dimensions of the apertures 7. Finally, the protective layers 3 and 5 are removed by means of a suitable solvent (for example sodium hydroxide solution) (FIG. 1E), after which plates can be cut from the tape 1, which plates, after further processing, may serve as shadow masks in colour display tubes.

The provision of the foil 11 of synthetic material may be carried out in various manners. One of these manners is shown diagrammatically in FIGS. 2 and 3. As is usual in etching shadow masks, the tape 1 is conveyed through a long etching machine in which all the processes are successively carried out. Such etching machines are known (see, for example, the U.S. Pat. No. 3,679,500) and therefore only a small part of such a machine is shown in FIGS. 2 and 3. The foil 11 is in the form of an endless tape which travels over two rollers 19 and 21 and engages the tape 1 over part of its length. The shafts 23 and 25 of the rollers are vertical, as well as the tape 1, and are journalled in the frame of the etching machine. Beside the first roller 19 at the level of the edges of the foil 11 two rollers 27 are provided on which adhesive tape is present which projects over the edge of the foil 11 and can thus adhere to said foil and to the part of the tape 1 projecting beyond the foil. During operation, the tape 1 is transported in the direction of the arrow 31, while the foil 11 travels along with the same speed. A pressure roller 33 ensures that the adhesive tape 29 which is unwound from the rollers 27 adheres to the foil 11 and the tape 1 so that the foil covers the tape in a liquid-tight manner during the transport of the tape through an etching space 35. A spray nozzle 37 is present in said etching space from which etching liquid is sprayed against the tape 1 by the action of a pump 39. Of course, the etching space 35 also comprises an outlet and after the tape 1 has passed the etching space, it may furthermore be conveyed through a rinsing space. These and possible further components are omitted from the figure to avoid complexity of the drawing.

After completion of the etching operation (possibly followed by a rinsing operation), the adhesive tape 29 is to be detached again from the tape 1. For that purpose, the adhesive tape 29 is wound on a set of winding rollers 41. The adhesive tape wound on the winding rollers is not used again in contrast with the foil 11 which returns to the roller 19 via the roller 21 and begins a new cycle there. It is also possible to use the foil 11 only once. For that purpose the roller 21 is to be replaced by a winding roller analogous to the winding rollers 41 for the adhesive tape 29, while the roller 19 is replaced by a storage reel.

Another possibility (not shown) of providing the foil 11 consists in that the foil itself is provided with an adhesive layer on one side, either throughout its width or only along its edges. In that case the adhesive tape 29 may be omitted.

The foil 11 may also be provided near the roller 19 along both edges with a layer of glue which loses its adhesive force at high temperature. The foil 11 in that case is glued near the roller 19 along both edges to the tape 1 and may be detached therefrom near the roller 21 by heating.

What is claimed is:

1. In an apparatus for etching apertures in a continuously moving thin metal tape, both surfaces of which tape have previously been provided with apertured etch resistant coatings, by bringing said tape into contact with an etching fluid and then removing said etching fluid from said tape, the improvement wherein said apparatus in addition comprises means for moving a section of an endless belt of an etch resistant synthetic resin material having a width at least as large as that of said metal tape in the same direction and at the same rate as said metal tape, means for bringing said section of said belt into substantial contact with a surface of said thin metal tape while both tape and belt are in motion, and means, prior to bringing said metal tape into contact with said etching fluid, for temporarily causing at least the edges of said belt to adhere to said thin metal tape in a manner such that upon bringing said tape into contact with said etching fluid, the etching fluid is prevented from reaching said surface of said tape in contact with said belt while the opposing surface of said tape is being etched.

2. The apparatus of claim 1 wherein the endless belt of the etch resistant material and the metal tape are both moved by roller means and the etching fluid is applied by spray means.

3. The apparatus of claim 2 wherein a surface of the endless belt is temporarily caused to adhere to the metal tape by means of a pressure sensitive adhesive tape situated between the endless belt and the metal tape and temporarily being joined to opposing surfaces of the endless belt and the metal tape by pressure roller means.

* * * * *